United States Patent [19]

Collins

[11] 3,983,078

[45] Sept. 28, 1976

[54] OIL REMOVAL DETERGENT COMPOSITIONS

[75] Inventor: Jerome H. Collins, Cincinnati, Ohio

[73] Assignee: The Procter & Gamble Company, Cincinnati, Ohio

[22] Filed: June 23, 1975

[21] Appl. No.: 589,117

Related U.S. Application Data

[63] Continuation-in-part of Ser. No. 406,413, Oct. 15, 1973, abandoned.

[30] Foreign Application Priority Data

Oct. 7, 1974 Canada ..... 210835

[52] U.S. Cl. ..... 252/540; 252/89 R; 252/135; 252/140; 252/153; 252/173; 252/545; 252/DIG. 1; 252/DIG. 14

[51] Int. Cl.[2] ..... C11D 1/72; C11D 1/83; C11D 3/075; C11D 3/12

[58] Field of Search ..... 252/DIG. 1, 89, 99, 252/135, 540, 559

[56] References Cited

UNITED STATES PATENTS

| | | | |
|---|---|---|---|
| 2,164,431 | 7/1939 | Schoeller | 260/615 |
| 3,619,119 | 11/1971 | Felletschin | 8/137 |
| 3,625,909 | 12/1971 | Berg | 252/153 |
| 3,679,608 | 7/1972 | Aubert | 252/526 |
| 3,707,506 | 12/1972 | Lozo | 252/139 |
| 3,849,347 | 11/1974 | Tokiwa | 252/545 |
| 3,850,832 | 11/1974 | Wegemund | 252/99 |
| 3,868,336 | 2/1975 | Mazzola | 252/527 |
| 3,870,647 | 3/1975 | Travers | 252/118 |

FOREIGN PATENTS OR APPLICATIONS

| | | | |
|---|---|---|---|
| 698,560 | 11/1964 | Canada | 252/139 |
| 2,125,836 | 12/1971 | Germany | 252/89 |
| 1,348,267 | 3/1974 | United Kingdom | 252/89 |

*Primary Examiner*—Dennis L. Albrecht
*Attorney, Agent, or Firm*—Julius P. Filcik; Robert B. Aylor; Thomas H. O'Flaherty

[57] ABSTRACT

Compositions and methods for dissolving oils and oily soils employing specific mixtures of short-chain and long-chain alkylene oxide nonionic surface active agents. The compositions herein can be employed singly in aqueous laundry baths to remove oily materials from fabrics, or can be admixed with commercial detergent compositions to boost the oil removal properties thereof.

1 Claim, No Drawings

OIL REMOVAL DETERGENT COMPOSITIONS

CROSS-REFERENCE TO RELATED APPLICATION

This is a continuation-in-part application of copending U.S. patent application Ser. No. 406,413; filed October 15, 1973; entitled OIL REMOVAL COMPOSITIONS; now abandoned; inventor: Jerome H. Collins.

BACKGROUND OF THE INVENTION

This invention relates to compositions and processes for solubilizing oils. More particularly, the invention relates to the use of specific mixtures of long-chain alkylene oxide surfactants and short-chain alkylene oxide co-surfactants, said mixtures having a hydrophilic-lipophilic balance (HLB) in the range of from about 10.8 to about 12.0 to remove oil from fabrics and other surfaces.

Current laundry products and procedures exhibit one or more deficiencies when used to clean oil stains, particularly hydrocarbon stains, from fabrics. Fatty triglyceride soils, especially those arising from natural body secretions, present another type of oily stain which is difficult to remove from modern fabrics by means of simply aqueous laundering processes. Such deficiencies are especially apparent when polyester or polyester fabric blends soiled with various oily materials are laundered in aqueous laundry baths. The oil removal problem is so acute that Smith, et al., *Textile Chemicals*, *Col.* 5, No. 7, 138 (1973) have concluded that detergent formulation alone is very unlikely to solve the problem of effecting satisfactory release of any broad spectrum of oils from today's durable press fabrics, unless the fabrics are specially finished with hydrophilic materials.

Heretofore, effective oil removal from modern fabrics has largely been accomplished by means of relatively inconvenient and expensive methods involving non-aqueous dry cleaning processes. Accordingly, compositions and processes which would provide the economical and efficient removal of oily soils and stains from fabrics employing conventional household laundry equipment are desirable.

The present invention employs combinations of long-chain and short-chain alkoxylated nonionic materials to effect the removal of oily materials from fabrics in an aqueous laundering process. The use of alkoxylated nonionic detergent materials in cleansing operations has been described, for example, in U.S. Pat. Nos. 2,133,480 and 2,164,431. The disclosures of these patents teach that the condensation products of aliphatic monohydric alcohols containing from 8 to about 18 carbon atoms with from 1 to 3 moles of ethylene oxide are useful in combination with various anionic surfactants in washing operations and for emulsifying oils.

U.S. Pat. No. 3,679,608 discloses the use of the ethoxylates of random secondary alcohols in low sudsing detergent compositions.

U.S. Pat. No. 3,008,905 teaches that the products produced by the addition of from 1 to about 4 moles of an alkylene oxide with alcohols containing, at most, 12 carbon atoms are suitable for use in detergent compositions.

U.S. Pat. No. 3,342,739 broadly describes the use of condensates comprising from about 3 to about 10 moles of ethylene oxide per mole of higher aliphatic $C_{10}$–$C_{20}$ hydrocarbyl alcohol in detergent compositions in combination with various polyethyleneoxy ethers of alkyl phenols and alkylolamides.

U.S. Pat. No. 3,619,119 discloses spot removal compositions containing mixed ethoxylates in combination with sulfated ethoxylate detergents for removing oily soils and stains from collars and cuffs of shirts and dresses.

Belgian Pat. No. 806,712 issued on Apr. 30, 1974 teaches the use of condensation products of fatty alcohols containing from 10 to 15 carbon atoms with 3 to 10 moles of ethylene oxide, said condensates having an HLB of from about 10 to about 13.5, together with various anionic detergents in laundering compositions.

German patent application DOS No. 2,125,836 published Dec. 2, 1971 discloses a builder-free liquid for cleaning metallic surfaces, particularly the external surfaces of aircraft, comprising mixtures of secondary alcohol ethoxylates of widely differing ethylene oxide content.

Canadian Pat. No. 860,898 broadly discloses nonionic mixtures composed of a conventional nonionic surfactant and a detergency improver which is a primary or secondary $C_8$–$C_{15}$ alcohol ethoxylate containing less than 51% by weight of ethylene oxide. Detergent compositions containing these mixtures are asserted to have improved detergency properties.

While the use of various alkoxylated nonionic mixtures in detergent compositions is known, the detergency arts have not heretofore recognized that certain combinations of short-chain and long-chain alkylene oxide condensates as disclosed herein afford superior oily soil removal. In fact, in view of the conflicting information in the prior art, the most that can be said is that various nonionic surfactants and mixtures have been broadly suggested for use in detergent compositions.

It has now been discovered that properly formulated mixtures of long-chain and short-chain alkoxylated nonionic surface active agents are especially useful in aqueous solutions for solubilizing oily soils and removing same from all manner of surfaces. Notably, the compositions herein are characterized by the speed with which they remove oils from fabrics, especially polyester and polyester blends; hence, they are useful for cleansing fabrics in the relatively limited time available in the deterging cycle of a home laundry operation. Moreover, the compositions herein can be employed singly to cleanse materials such as fabrics, or can be added to various commercial laundry detergent compositions to enhance the oil removal properties thereof.

The compositions herein are useful for cleaning and degreasing a variety of surfaces other than textiles and are useful, for example, in the metal working trades and as hard surface cleaners for use on floors and walls.

It is an object of the present invention to provide compositions and processes for solubilizing oils and for removing oily soils from surfaces.

A second object herein is to provide compositions and processes for removing oils and oily soil from fabrics in a home laundry operation.

It is a further object of this invention to provide additive compositions which can be employed with commercial laundry detergents to enhance the oil removal efficacy thereof.

These and other objects are obtained herein, as will be seen by the following disclosure.

SUMMARY OF THE INVENTION

The instant invention encompasses a granular detergent composition especially adapted for removing oil and oily soil from fabrics, said composition consisting essentially of:

a. from about 15% to about 40% by weight of an ethoxylated nonionic surfactant mixture of which about 60%–80% by weight of the mixture is a water-soluble $C_9$–$C_{11}$ primary alcohol having an average of 10 carbon atoms in the alkyl chain condensed with an average of four ethylene oxide groups to give an HLB of about 10.5 and about 20% to about 40% by weight of the mixture is the condensate of a secondary $C_{10}$–$C_{15}$ alcohol mixture having an average of 12–13 carbon atoms in the alcohol molecule with about 7–9 ethylene oxide groups to give an HLB of from 12.0–15.0, said surfactant mixture having an overall HLB of from 10.5–12.0;

b. from about 1% to about 20% by weight of a detergent compound selected from the group consisting of anionic, semipolar and zwitterionic surfactants; and c. from about 30% to about 70% by weight of a detergency builder selected from the group consisting of organic and inorganic builder salts.

Thus formulated, the mixtures produce essentially zero interfacial tensions (e.g., 0.03 dyne/cm at equilibrium) at a hydrocarbon-water interface.

The compositions herein can be employed singly to remove oils and oily soils from surfaces by contacting same with an aqueous solution containing from about 0.02% to about 0.50% by weight of said compositions. Moreover, the compositions herein can be added to both built and unbuilt commercial-type detergent compositions in the ratios and proportions hereinafter disclosed to enhance the oil removal properties of said commercial detergent compositions.

DETAILED DESCRIPTION OF THE INVENTION

The oil solubilization and detergent additive compositions herein comprise two essential ingredients, a long-chain alkoxylated nonionic surfactant and a short-chain alkoxylated nonionic co-surfactant. While not intending to be limited by theory, it appears that the co-surfactant employed herein must be selected to provide rapid transport from the aqueous liquor into the oil which is to be removed from the surface being treated. Once established in the oil phase, the co-surfactant and surfactant (which remains substantially in the aqueous phase) co-act to produce a zero interfacial tension at the water-oil interface. A positive interfacial free energy is created and this force causes the oil to disperse and dissolve in the aqueous liquor, thereby removing said oil from the surface.

While many surface active agents presumably will migrate from a water phase into an oil phase on long standing, they are kinetically slow, and are not useful in the relatively short time (ca. 10–15 minutes) available in the deterging cycle of a home laundry operation or in hard surface cleaning. Moreover, surface active agents which do migrate relatively quickly will not, by themselves, cause the requisite lowering of the water-oil interfacial tension to provide a driving force for the formation of thermodynamically stable micellar solution (with the oil truly solubilized). It is only when the proper combination of surfactant and co-surfactant is selected that rapid and effective solubilization of oil occurs.

From the foregoing it is seen that both thermodynamic and kinetic factors must be considered when formulating oil-dissolving compositions for use in aqueous media. It has been discovered that, by selecting alkoxylated nonionic surfactants of the type disclosed herein having the proper hydrophilic-lipophilic balance and combining them with alkoxylated nonionic co-surfactants of the type disclosed herein having the proper hydrophilic-lipophilic balance to provide mixtures having the proper overall hydrophilic-lipophilic balance, both the kinetic and thermodynamic requirements of a through-the-wash oil solubilizing detergent are satisfied.

MIXTURE COMPONENTS

The individual surface active agents employed in the mixtures herein are well known and are commonly thought of as constituting a hydrocarbyl chain condensed with an alkylene oxide chain. The hydrocarbyl portion of such materials give rise to their lipophilic characteristics, whereas the alkylene oxide portion determines their hydrophilic characteristics. The overall hydrophilic-lipophilic characteristics of a given hydrocarbyl-alkylene oxide condensate are reflected in the balance of these two factors, i.e., the hydrophilic-lipophilic balance (HLB). The HLB of alkoxylated nonionics can be experimentally determined in well known fashion, or can be calculated as described more fully hereinafter. Conversely, specifying the alkoxyl content and the HLB of a hydrocarbyl alkoxylate fully characterizes such compounds since the hydrocarbon content of the molecule can be approximated by reverse-calculation.

Alkoxylated nonionic surface active agents of the type used herein can be prepared by methods well known in the art. In general terms, a hydrocarbyl material having at least one —OH group is condensed with one or more moles of an alkylene oxide, e.g., ethylene oxide or propylene oxide. Mixed alkoxylates can be formed by condensing the hydrocarbyl compound with mixtures of alkylene oxides, e.g., mixtures of ethylene oxide and propylene oxide. The common terminology employed to designate the structures of such materials usually specifies both the nature of the hydrocarbyl group and the degree and type of alkylene oxide substitution. For example n-$C_{10}$EO(9), a preferred long-chain surfactant herein, is n-decanol condensed with 9 moles of ethylene oxide per mole of alcohol. Likewise, n-$C_{10}$EO(4), a preferred short-chain co-surfactant herein, is n-decanol condensed with 4 moles of ethylene oxide per mole of alcohol. An example of a mixed alkoxylate is $C_{10}$EO(3)PO(2), wherein PO is the propylene oxide moiety.

The nonionic alkoxylates used herein both as surfactants and co-surfactants can be prepared from all manner of hydroxylated hydrocarbyl materials such as branched chain and straight chain alcohols and alkylphenols; primary, secondary and tertiary alcohols; olefinic alcohols and the like, having the requisite number of carbon atoms disclosed herein. Glycols and poly-ols can also be used, but monohydric alcoholic and monohydric alkyl phenolic alkoxylates are preferred, with said alcohol alkoxylates being most preferred. Again, the names of such compounds often reflects the nature of both the hydrocarbyl group and the nature and molecular proportions of the alkylene oxide group. For example, Tergitol 15-S-9 is the commercial name of a preferred long-chain surfactant herein which is the condensate of 9 moles of ethylene oxide with one mole of a secondary monohydric alcohol averaging 13 carbon atoms in length. Tergitol 13-S-5, which is a preferred short-chain co-surfactant herein, is the condensate of 5 moles of ethylene oxide with one mole of a $C_{12}$ (avg.) secondary monohydric alcohol.

The long-chain surfactants used in the present compositions and processes are characterized by a hydrophilic chain of at least 5 alkylene oxide groups and an HLB in the range of from 11.7 to about 17. The short-chain co-surfactants herein comprise water-soluble $C_8$–$C_{11}$ primary alcohols with a hydrophilic chain of 3.5–5 ethylene oxide groups and an HLB in the range of from 10.2 to about 10.5. As noted, the carbon content of the lipophilic hydrocarbyl portion of the alkoxylated nonionic surfactants and co-surfactants can be approximately reverse-calculated when the HLB and degree of alkoxylation are as specified.

A. Surfactant Component

The term "long-chain" alkoxylated nonionic surfactant herein encompasses the hydrocarbyl alkylene oxide condensates of the formula:

$$R—O—(C_yH_{2y}O)_a—(C_zH_{2z}O)_b—C_wH_{2w}OH$$

wherein R is selected from the group consisting of primary, secondary and branched chain (primary and secondary) alkyl hydrocarbyl moieties; primary, secondary and branched chain (primary and secondary) alkenyl hydrocarbyl moieties; and primary, secondary and branched chain alkyl- and alkenyl-substituted phenolic hydrocarbyl moieties, and having an HLB in the range disclosed hereinabove. In the general formula for the surfactants herein, $y$ and $z$ are each integers of from 2 to 3, preferably 2, and $w$ is an integer of from 2 to 3, preferably 2.

In the general surfactant formula, the carbon content of group R will vary somewhat, depending on whether R represents a primary or secondary alcohol or an alkyl- or alkenyl-phenolic group. When R is a primary alcohol, its carbon content is in the range of $C_8$–$C_{15}$, preferably $C_{10}$–$C_{13}$. When R is a secondary alcohol, its carbon content is in the range of $C_{10}$–$C_{15}$, preferably $C_{10}$–$C_{13}$. When R is an alkyl phenol group, the carbon content of the alkyl portion is in the range of 7–9, preferably 8, carbon atoms. Chain branching and points of unsaturation have no substantial effect on the specified carbon content of group R.

In the general surfactant formula, $a$ and $b$ are each integers of 0 to about 11, the sum of $a + b$ being in the range of from 4 to about 11. The formula of the surfactants encompasses ethylene oxide (EO) as well as mixed EO-PO alkoxylates, all of which are useful herein. The all-PO surfactants do not have the requisite HLB—s and are not contemplated for use herein. The EO alkoxylates are preferred by virtue of their cost and availability.

Of course, by defining the hydrocarbyl content of group R and the HLB, the degree of alkoxylation (i.e., the sum of $a+b$) is necessarily defined. Again, however, this will vary somewhat, depending on the nature of R. For the preferred all-EO surfactants herein, when R is a primary alcohol moiety, the sum of $a+b$ is 4–10 (preferably 6–9) and the overall ethoxylate range is 5–11, due to the presence of the terminal group in the hydrophilic portion of the molecule. When R is a secondary alcohol, the sum of $a+b$ is 5–11 (preferably 6–9). When R is an alkyl phenol, the sum of $a+b$ is 5–11 (preferably 6–9). When mixed EO-PO surfactants are employed, the values of $a$ and $b$ can be calculated by assigning the disclosed hydrocarbyl ranges of R, the overall HLB values, and by using hydrophilicity values for EO and PO groups obtainable from standard tables.

Specific examples of long-chain surfactants useful herein are as follows. The examples are only by way of exemplification and are not intended to be limiting of such materials.

i. Straight-chain, primary alcohol alkoxylates

The penta-, octa-, nona-, deca-, and undecaalkoxylates of n-octanol, n-decanol, n-dodecanol, n-tetradecanol, and n-pentadecanol having an HLB within the range recited herein are useful surfactants in the context of this invention; the respective ethylene oxide condensates are the most preferred akoxylates. The n-$C_{9\text{-}11}EO_n$ condensates are preferred. Exemplary alkoxylated primary alcohols useful herein as the surfactant component of the mixtures are: n-$C_{10}$EO(6); n-$C_{10}$EO(9); n-$C_{11}$EO(9); n-$c_{12}$EO(9); n-$C_{14}$EO(10); n-$C_{10}$EO(10); n-$C_9$EO(9); n-$C_{15}$EO(11); and n-$C_{10}$EO(6-)PO(2). The most preferred pure, straight chain, primary alcohol alkoxylates herein are n-$C_{10}$EO(6) and n-$C_{10}$EO(9).

ii. Straight-chain, secondary alcohol alkoxylates

The hexa-, hepta-, octa-, nona-, deca-, and undecaalkoxylates of 2-decanol, 2-undecanol, 3-dodecanol, 2-dodecanol, 4-tridecanol and 2-pentadecanol having an HLB within the range recited herein are useful surfactants in the context of this invention; the respective ethylene oxide condensates are the most preferred alkoxylates. Exemplary alkoxylated secondary alcohols useful herein as the surfactant component of the mixtures are: 2-$C_{10}$EO(9); 2-$C_{12}$EO(9); $2_{14}$EO(10); 2-$C_{15}$EO(11); 4-$C_{10}$EO(9); 2-$C_{15}$EO(12); and 2-$C_{10}$EO(9)PO(3). Preferred straight chain, secondary alcohol alkoxylates herein are the materials marketed under the tradename Tergitol 15-S-9 and Tergitol 15-S-7, which comprise a mixture of secondary alcohols having an average hydrocarbyl chain length of 13 carbon atoms condensed with an average of 9 and 7 moles of ethylene oxide per mole equivalent of alcohol, respectively.

iii. Alkyl phenolic alkoxylates

As in the case of the secondary alcohol alkoxylates, the hexa-through undeca-alkoxylates of alkylated phenols, particularly monohydric alkylphenols, having an HLB within the range recited herein are useful as the surfactant component of the instant mixtures. The respective ethylene oxide condensates are the most preferred alkoxylates. The hexa-through undeca-alkoxylates of p-hexaphenol, m-octylphenol, p-octylphenol, p-nonylphenol and the like are useful herein; most preferred are the ethoxylates of p-octylphenol and p-nonylphenol, inasmuch as these materials are readily available. Exemplary alkoxylated alkyl phenols useful as the surfactant component of the mixtures herein are: p-octylphenol EO(9); p-nonylphenol EO(9); p-decylphenol EO(9); p-dodecylphenol EO(10); and p-octylphenol EO(9)PO(2). The most preferred alkylphenol alkoxylates herein are p-octylphenol (nonoxyethylene) and p-nonylphenol (nonoxyethylene).

iv. Olefinic alkoxylates

The alkenyl alcohols, both primary and secondary, and alkenyl phenols corresponding to those disclosed immediately hereinabove can be alkoxylated to an HLB within the range recited herein and used as the surfactant component of the instant mixtures. Typical alkenyl alkoxylates herein are 2-n-dodecenol EO(9); 3-n-tetradecenol EO(9); p-(2-nonenyl)-phenol EO(9) PO(2); and 2-tetradecen-4-ol EO(9).

v. Branched chain alkoxylates

Branched chain primary and secondary alcohols which are available by the well known OXO process can be alkoxylated and employed as the surfactant component of mixtures herein. Exemplary branched-chain alkoxylates are as follows: 2-methyl-1-dodecanol EO(9); 3-ethyl-2-tetradecanol EO(9); 2-methyl-1-tetradecanol EO(9)PO(2) and the like. The ethylene oxide condensates of predominantly linear alcohols (<25% 2-methyl branching) having HLB's within the range specified for the surfactant component of the instant mixtures are preferred herein. Most preferred of these alkoxylates are commercial mixtures known as Dobanol 91-5, 91-6 and 91-8.

B. Co-Surfactant Component

The term short-chain alkoxylated nonionic cosurfactant herein encompasses the hydrocarbyl alkylene oxide condensates of the formula:

$$R^1-O-(C_2H_4O) \quad -C_2H_4OH$$

wherein $R^1$ is selected from the group consisting of primary, secondary and branched chain (primary and secondary) alkyl hydrocarbyl moieties; and primary, secondary and branched chain (primary and secondary) alkenyl hydrocarbyl moieties; and having an HLB in the range disclosed hereinabove.

In the general co-surfactant formula, the carbon content of group $R^1$ will vary somewhat, depending on whether $R^1$ represents a primary or secondary alcohol or an alkyl- or alkenyl-phenolic group. When $R^1$ is a primary alcohol, its carbon content is in the range of $C_8$–$C_{11}$, preferably $C_9$–$C_{11}$, most preferably $C_{10}$. When $R^1$ is a secondary alcohol, its carbon content is in the range of $C_{10}$–$C_{15}$, preferably $C_{10}$–$C_{13}$. Chain branching and points of unsaturation have no substantial effect on the specified carbon content of group $R^1$.

In the general co-surfactant formula, $\alpha$ is an integer of from 3.5–5 to about 5, the precise value being dependent on the alcohol type and alkyl chain length.

Of course, by defining the hydrocarbyl content of group $R^1$ and the HLB, the degree of alkoxylation is necessarily defined. Again, however, this will vary somewhat, depending on the nature of $R^1$. When $R^1$ is a primary alcohol moiety, $\alpha$ is about 3.5–4.5 due to the presence of the terminal group in the hydrophilic portion of the molecule. When $R^1$ is a secondary alcohol, $\alpha$ is 4–5.

Specific examples of short-chain co-surfactants useful herein are as follows. The examples are only by way of exemplification and are not intended to be limiting of such materials.

i. Straight-chain, primary alcohol alkoxylates

The tri-, tetra-, and penta-ethoxylates of n-octanol, n-nonanol, n-decanol, and n-undecanol having an HLB within the range recited herein are useful co-surfactants in the context of this invention. The most preferred straight chain, primary alcohol alkoxylate co-surfactant herein is n-$C_{10}$(EO)4.

ii. Straight-chain, secondary alcohol alkoxylates

The tri-, tetra- and penta-ethoxylates of 2-nonanol, 3-decanol, 2-decanol, 3-tetradecanol, and 5-pentadecanol having an HLB within the range recited herein are useful co-surfactants in the context of this invention; other useful linear secondary alcohol ethoxylates are those comprising a mixture of $C_{11}$ and $C_{12}$ alcohols condensed with an average of about 4.5 ethylene oxide groups and a mixture of $C_{13}$ and $C_{14}$ alcohols condensed with an average of 5 ethylene oxide groups. A highly preferred straight-chain, secondary alcohol alkoxylate herein is the material marketed under the tradename Tergitol 13-S-5, which comprises a mixture of secondary alcohols having an average hydrocarbyl chain length of 12 carbon atoms condensed with an average of 5 moles of ethylene oxide per mole equivalent of alcohol.

iv. Olefinic alkoxylates

The alkenyl alcohols, both primary and secondary, corresponding to those disclosed immediately hereinabove can be alkoxylated to an HLB within the range recited herein and used as the co-surfactant component of the instant oil solubilizing mixtures. Typical alkenyl alkoxylates useful herein are 2-n-decenol EO(4) and 2-penta-decen-4-ol EO(5).

v. Branched-chain alkoxylates

Branched-chain primary and secondary alcohols which are available by the well-known OXO process can be ethoxylated to an HLB within the co-surfactant range noted herein and employed in the instant mixtures.

The foregoing alkoxylates can be employed herein as the pure compounds or as mixtures. When prepared on a commercial scale, the alkoxylates are usually not the individual pure compounds listed, but rather comprise mixtures having an average degree of alkoxylation and an average lipophilic hydrocarbon chain length corresponding to the ranges disclosed herein for the surfactants and cosurfactants. Moreover, fractional average values for the alkoxylates occur in such mixtures, i.e., mixtures such as n-$C_{10.5}(EO)_{4.5}$. Such mixtures are fully contemplated for use herein.

The compositions herein comprise mixtures of the aforesaid surfactants and co-surfactants. Such mixtures are characterized as having an HLB in the range of from 9 to 13. The HLB's of the surfactants, co-surfactants and mixtures herein can be calculated in the manner set forth in Becker, "Emulsions Theory and Practice" Reinhold 1965 pp. 233 and 248. For example, the equation:

$$HLB = E/5$$

wherein E is the weight percentage of oxyethylene content, can be used to calculate the HLB of the normal fatty alcohol ethoxylates employed herein.

For mixtures of surfactant (A) and co-surfactant (B), the composite HLB is calculated as follows:

$$HLB_{(mix)} = \text{wt. fraction A} \times HLB_A + \text{wt. fraction B} \times HLB_B$$

Alternatively, the weight fraction of the co-surfactant which must be used with a given surfactant to provide a mixture having an HLB within the range recited herein can be calculated as follows:

$$\text{wt. fraction co-surfactant} = \frac{HLB\ \text{surf.} - HLB\ \text{mixt.}}{HLB\ \text{surf.} - HLB\ \text{co-surf.}}$$

On the basis of the foregoing, it is possible to calculate the weight of short chain co-surfactant of the type disclosed herein which must be combined with the long chain surfactant of the type disclosed herein to provide a mixture having a mixture HLB within the required range. Moreover, such mixtures will provide an interfacial tension at a hydrocarbon/water interface of essentially zero. Accordingly, such compositions effect the solubilization of oil in aqueous media with rapid kinetics.

Oil solubilizing mixtures of surfactant and co-surfactant can be determined experimentally by measuring the ability of test mixtures to provide a clear, aqueous solution or clear dispersion of n-dodecane in water. In a typical procedure, n-dodecane is added to a 0.3% (wt.) aqueous solution of the surfactant/co-surfactant mixture at a ratio of said mixture:n-dodecane of about 1:0.5 to 1:1, with stirring. Stirring is continued for 30 minutes and the results observed visually. Under these test conditions, the mixtures herein result in a micellar solution (or clear stable dispersion) of the n-dodecane in water (sometimes referred to as a "microemulsion") whereas other detergent systems result in a cloudy emulsion, or unstable dispersion of n-dodecane in water.

An alternate procedure for determining surfactant/co-surfactant mixtures of the type disclosed herein comprises evaluating their ability to remove dirty motor oil (automobile crankcase oil) from cloth swatches. In a typical test, 0.01 ml. of dirty motor oil is placed on a fabric, which can be cotton, polyester or blends. The swatch is then laundered in water at 100°F to 140°F containing 0.02% to 0.05% of the mixtures herein. The oil removal is then evaluated visually, or by means of a Gardner meter. Typical mixtures herein remove up to 98% of the dirty motor oil, whereas other detergent systems result in little, or no, oil removal.

Non-limiting examples of nonionic components useful in the invention are listed below together with their HLB values and mixtures of these components appear in Table I.

TABLE 1

| Typical Individual Components | HLB |
|---|---|
| $C_{10}E_4$ | 10.5 |
| therefor | |
| Dobanol** 91-4 | 10.5 |
| therefor | |
| Tergitol* 15-S-5 | 10.5 |
| Tergitol 13-S-5 | 10.7 |
| Tergitol 13-S-9 | 13.6 |
| Tergitol 15-S-7 | 12.1 |
| Tergitol 15-S-9 | 13.3 |
| Tergitol 15-S-12 | 14.5 |
| Dobanol 91-5 | 11.7 |
| $C_{10}E_5$ | 11.7 |
| Dobanol 91-6 | 12.5 |
| Dobanol 91-8 | 14.1 |
| $C_{10}E_6$ | 12.5 |
| $C_{10}E_9$ | 14.3 |
| Sec-$C_{11-12}(EO)_{4.5}$ | 10.5 |
| Sec-$C_{13-14}(EO)_5$ | 10.3 |
| Sec-$C_{11-12}(EO)_9$ | 13.9 |
| Sec-$C_{13-14}(EO)_7$ | 12.0 |
| Sec-$C_{13-14}(EO)_9$ | 13.2 |

*The Tergitols are secondary alcohol mixtures marketed by Union Carbide Corporation. Tergitol 13 is a $C_{11}$–$C_{13}$ alcohol mixture with an average hydrocarbon chain length of 12; Tergitol 15 is a $C_{11}$–$C_{15}$ alcohol mixture with an average of 13 carbon atoms in the chain. The S-5, S-7, and S-9 designations indicate an average degree of ethoxylation of 5, 7, and 9, respectively.

**The Dobanols are primary "oxo" alcohols marketed by Shell Chemicals U.K. Ltd. Dobanol 91 is a mixture of alcohols having an average molecular weight of 160 and a range of chain length between $C_9$ and $C_{11}$, with the major proportion being $C_{10}$. The final integers 4, 5, 6 and 8 indicate average degrees of ethoxylation of 4, 5, 6 and 8, respectively.

| Mixture Components (wt.%) | HLB Mixture |
|---|---|
| 60% n-$C_{10}(EO)_4$, 40% Tergitol 15-S-7 | 11.1 |
| 65% Dobanol 91-4, 35% Tergitol 15-S-7 | 11.1 |
| 80% n-$C_{10}(EO)_4$, 20% Tergitol 15-S-9 | 11.1 |
| 85% Dobanol 91-4, 15% Tergitol 15-S-9 | 10.9 |
| 80% n-$C_{10}(EO)_4$, 20% n-$C_{10}(EO)_6$ | 10.9 |
| 85% Dobanol 91-4, 15% Dobanol 91-6 | 10.8 |
| 80% Dobanol 91-4, 20% Tergitol 13-S-9 | 11.1 |
| 65% n-$C_{10}(EO)_4$, 35% Dobanol 91-5 | 10.9 |
| 55% Tergitol 15-S-5, 45% Tergitol 15-S-9 | 11.7 |
| 25% Tergitol 15-S-5, 75% Tergitol 15-S-7 | 11.7 |
| 55% Tergitol 13-S-5, 45% Tergitol 15-S-9 | 11.9 |
| 55% Tergitol 13-S-5, 45% Tergitol 13-S-9 | 11.8 |
| 20% s-$C_{13-14}(EO)_5$, 80% s-$C_{13-14}(EO)_7$ | 11.7 |
| 50% s-$C_{13-14}(EO)_5$, 50% s-$C_{13-14}(EO)_9$ | 11.8 |
| 55% s-$C_{11-12}(EO)_{4.5}$, 45% s-$C_{11-12}(EO)_9$ | 12.0 |
| 20% s-$C_{11-12}(EO)_{4.5}$, 80% s-$C_{13-14}(EO)_7$ | 11.7 |

The foregoing optimized mixtures can be used singly to clean and degrease fabrics, metals and other hard surfaces. Alternatively, the mixtures can be employed as oil solubilization systems which can optionally be combined with adjuvant materials, as disclosed hereinafter.

The surfactants and co-surfactants employed herein can be prepared, for example, in the manner disclosed in U.S. Pat. No. 2,164,431, incorporated herein by reference. Mixed materials, e.g., EO-PO surfactants and co-surfactants, can be prepared as described in U.S. Pat. No. 3,650,965, incorporated herein by reference. The Tergitol 13-S-5 and Tergitol 15-S-9 materials are available from the Union Carbide Corporation. The Dobanols are available from Shell Chemicals U.K. Ltd. U.S. Pat. No. 2,355,823, incorporated herein by reference, teaches the preparation of secondary alcohol alkoxylates. U.S. Pat. No. 2,508,035, incorporated herein by reference, teaches the preparation of branched chain secondary alkoxylates. U.S. Pat. No. 2,508,036, incorporated herein by reference, teaches the preparation of branched chain primary alkoxylates. The phenolic alkoxylates are also available from various commercial sources.

OPTIONAL DETERGENTS AND ADJUVANTS

As noted, the nonionic mixtures of the instant invention can be employed in a variety of compositions and processes where solubilization of oil or grease is desired. The most common situation calling for oil and grease solubilization is in the area of stain removal from fabrics during aqueous laundering operations. The instant nonionic oil solubilization systems can be utilized alone for fabric stain laundering, but are more commonly employed in combination with other conventional detergent formulation materials. Such optional materials include, for example, conventional surfactants and builders. The following list of such detergent adjuvants which can be used in combination with the alkoxylated nonionic long chain surfactant-plus-short chain co-surfactant mixtures is typical of such adjuvant materials, but is not intended to be limiting.

DETERGENTS

Optional detergents useful in the embodiments of the present invention include all manner of anionic, semipolar, zwitterionic and amphoteric organic, water-soluble detergent compounds, inasmuch as the nonionic mixtures herein are compatible with all such materials. A typical listing of the classes and species of detergent compounds useful herein appears in U.S. Pat. No.

3,664,961, Column 2 Line 70 to Column 9 Line 3, incorporated herein by reference. Compositions comprising from about 1% to about 99% (preferably 15% to 40%) by weight of the alkoxylated surfactant mixtures herein and from about 1% to about 60% (preferably 1% to 20%) of one or more optional detergent components are especially useful as heavy duty cleaning compositions.

Preferred water-soluble organic detergent compounds herein include linear alkyl benzene sulfonates containing from about 11 to 14 carbon atoms in the alkyl group particularly the sodium and triethanolamine salts, the sodium tallow range alkyl sulfates; the sodium coconut range alkyl glyceryl ether sulfonates and alkyl ether sulfates wherein the alkyl moiety contains from about 14 to 18 carbon atoms (particularly the tallow alkyl range) and wherein the average degree of ethoxylation varies between 1 and 10; sodium olefin sulfonates containing from about 14 to 16 carbon atoms; alkyl dimethyl amine oxides wherein the alkyl group contains from about 11 to 16 carbon atoms; alkyldimethyl-ammonio-propane-sulfonates and alkyldimethylammonio-hydroxy-propane-sulfonates wherein the alkyl group in both types contains from about 14 to 18 carbon atoms; and soaps, as hereinabove defined.

An especially preferred alkyl ether sulfate detergent component useful in the instant compositions and processes is disclosed in Belgian Pat. Nos. 807,262 and 807,263 both issued May 13, 1974 and specifically incorporated herein by reference.

It is to be recognized that any of the foregoing detergents can be used separately herein or as mixtures.

ADJUVANT MATERIALS

The herein-disclosed compositions can contain, in addition to the nonionic mixtures and optional organic detergent compounds, all manner of detergency builders commonly taught for use in detergent compositions. Such builders can be optionally employed in the present compositions at concentrations of from about 0% to about 90% by weight, preferably from about 30% to about 70% by weight, of said optional builders. Useful builders herein include any of the conventional inorganic and organic water-soluble builder salts.

Such detergency builders can be, for example, water-soluble salts of phosphates, pyrophosphates, orthophosphates, polyphosphates, phosphonates, carbonates, polyhydroxysulfonates, silicates, polyacetates, carboxylates, polycarboxylates and succinates. Specific examples of inorganic phosphate builders include sodium and potassium tripolyphosphates, pyro phosphates and hexametaphosphates. The polyphosphonates specifically include, for example, the sodium and potassium salts of ethylene diphosphonic acid, the sodium and potassium salts of ethane 1-hydroxy-1, 1-diphosphonic acid and the sodium and potassium salts of ethane-1,1,2-triphosphonic acid. Examples of these and other phosphorous builder compounds are disclosed in U.S. Pat. Nos. 3,159,581; 3,213,030; 3,422,021; 3,422,137; 3,400,176 and 3,400,148, incorporated herein by reference.

Non-phosphorus containing sequestrants can also be selected for use herein as detergency builders.

Specific examples of non-phosphorus, inorganic builder ingredients include water-soluble inorganic carbonate, bicarbonate, and silicate salts. The alkali metal, e.g., sodium and potassium, carbonates, bicarbonates, and silicates are particularly useful herein.

Water-soluble, organic builders are also useful herein. For example, the alkali metal, ammonium and substituted ammonium polyacetates, carboxylates, polycarboxylates and polyhydroxysulfonates are useful builders in the present compositions and processes. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorous builder materials herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Other highly preferred builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid and methylenemalonic acid.

Additional, preferred builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate and phloroglucinol trisulfonate.

Another type of detergency builder material useful in the present compositions and processes comprises a water-soluble material capable of forming a water-insoluble reaction product with water hardness cations in combination with a crystallization seed which is capable of providing growth sites for said reaction product. Such "seeded builder" compositions are fully disclosed in Belgian Pat. No. 798,856 issued Oct. 29, 1973 the disclosures of which are incoporated herein by reference.

A further class of detergent builders found to be useful in the present invention are certain insoluble alumino silicates. Detergent compositions incorporating these alumino silicate materials are disclosed in Belgian Pat. No. 814,874 issued Nov. 12, 1974, the disclosures of which are herein incorporated by reference.

The compositions herein can optionally contain all manner of additional materials commonly found in laundering and cleaning compositions. For example, thickeners and soil suspending agents such as carboxymethyl-cellulose and the like can be included in the compositions. Enzymes, especially the thermally stable proteolytic and lipolytic enzymes commonly used in high temperature laundry detergent compositions, can also be present herein. Various perfumes, optical bleaches, fillers, anti-caking agents, fabric softeners and the like can be present to provide the usual benefits occasioned by the use of such materials in detergent compositions. Perborate bleaches commonly employed in European detergent compositions can also be present as a component of the compositions herein. It is to be recognized that all such adjuvant materials are useful, inasmuch as they are compatible and stable in the compositions herein.

The alkoxylated nonionic mixtures herein can be used separately as detergent compositions, but are most often employed at a concentration of from about 5% to about 95% (preferably 8%–45%) by weight in combination with 0% to 95% (preferably 55%–95%) by weight of a carrier. Liquid carriers include water and water-alcohol mixtures, e.g., 90:10 (wt.) water-ethanol; 80:20 (wt.) water:n-propanol; 70:30 (wt.) water-isopropanol; 95:5 (wt.) water-n-butanol, and the like. Water-ethanol mixtures at weight ratios of water-:ethanol of 95:5 to 1:1 are especially preferred liquid carriers herein.

Solid, sorbent carriers for the present nonionic mixtures include any of the hereinabove disclosed water-soluble solid builder materials, as well as water-insoluble solids such as the microfine silicas, clays, kieselguhr, vermiculites and the like. The nonionic mixtures are sorbed on such solid carriers at a weight ratio of nonionic: carrier from about 1:20 to 20:1 for use in dry detergent compositions. The appropriate ratio will, of course, depend on the sorbency of the carrier, and be readily determined experimentally.

The concurrently-filed commonly assigned application of Wise, Ser. No. 589,116, filed June 23, 1975, Attorney's Docket No. 2020R, discloses the use of kaolinite or bentonite clay to provide a crutcher-stable nonionic surfactant/clay mixture suitable for use in the preparation of spray-dried detergent granules. Kaolinite or bentonite clay employed in this manner is a preferred water-insoluble carrier for preparing spray-dried detergent granules containing the nonionic mixtures of the present invention.

The following examples illustrate various compositions employing the nonionic oil solubilization systems of this invention. The materials employed in the formulation of said compositions are commercially available, or can be prepared by methods well known in the art.

EXAMPLE I

A liquid oil-dissolving composition is as follows:

| Component | Wt. % |
|---|---|
| n-$C_{10}(EO)_4$ | 80 |
| Tergitol 15-S-9 | 20 |

The above composition is dissolved in water at a concentration of 0.11% by weight. Oily metal surfaces and oil-stained rags are cleansed by agitating same with the solution for periods of from about 1 minute to about 10 minutes, depending on the amount of oil to be removed.

EXAMPLE II

A spray-dried, granular detergent composition is as follows:

| Crutcher Mix | |
|---|---|
| Ingredient | Grams |
| Sulfated tallow alcohol | 2.0 |
| Linear alkylbenzene sulfonate (alkyl = $C_{11.8}$ avg.) | 2.0 |
| Calcium carbonate (1.0 micron) | 9.0 |
| Sodium carbonate | 30.0 |
| Sodium sulfate | 9.7 |
| Sodium sulfosuccinate | 2.0 |
| Sodium toluene sulfonate | 2.0 |
| Sodium silicate ($SiO_2$:$Na_2O$ = 2.0) | 10.0 |
| Water | 45.0 |

-continued

| Pre-Slurry | |
|---|---|
| Ingredient | Grams |
| Tergitol 15-S-7 | 8.0 |
| n-decanol $(EO)_4$ | 12.0 |
| Kaolinite clay (1.0 micron) | 6.5 |

The kaolinite clay and the nonionic surfactants are admixed separately from the crutcher mix as a pre-slurry at a temperature of 150°F and blended thoroughly at this temperature for about 5 minutes until a smooth slurry is obtained. The crutcher mix ingredients are separately mixed and raised to a temperature of 150°F. The hot kaolinite-nonionic slurry is then admixed with the hot crutcher mix and blended. The resulting homogeneous crutcher mix is spray dried at 200°C to provide a granular detergent composition.

The foregoing composition is employed as a 0.1% aqueous solution and provides superior oil removal from polyester fabrics when laundered at 100°F–110°F.

In the foregoing composition, the anionic surfactant component of the crutcher mix comprising the sulfated tallow alcohol and the linear alkylbenzene sulfonate is replaced by an equivalent amount of sodium linear $C_{10}$–$C_{18}$ alkylbenzene sulfonate; triethanolamine $C_{10}$–$C_{18}$ alkylbenzene sulfonate; sodium tallow alkyl sulfate; sodium coconut alkyl glycerylether sulfonate; the sodium salt of a sulfated condensation product of a tallow alcohol containing from about 3 to about 10 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio)-hexanoate; dodecyl dimethyl amine oxide; coconutalkyldimethyl amine oxide; and the water-soluble sodium and potassium salts of higher fatty acids containing 8 to 24 carbon atoms, respectively, and equivalent results are secured.

In the foregoing composition, the seeded builder comprising the mixture of sodium carbonate and calcium carbonate is replaced by a total of 40 grams of the following builders, respectively: sodium nitrilotriacetate; sodium citrate; sodium oxydisuccinate; sodium mellitate; sodium ethylenediaminetetraacetate; sodium carboxymethyloxymalonate; sodium carboxymethyloxysuccinate; sodium cis-cyclohexanehexacarboxylate; sodium cis-cyclopentanetetracarboxylate; and the sodium salt of phloroglucinol trisulfonate, respectively, and equivalent results are secured.

The foregoing compositions exhibit excellent removal of oil and clay soil from fabrics when employed in aqueous laundry baths at concentrations of 0.04% (wt.), and greater. The compositions also provide excellent hard surface cleaners useful for scrubbing walls, floors and dishes.

EXAMPLE III

A spray-dried granular detergent composition prepared in the manner of this invention is as follows:

| Ingredient | Wt. % |
|---|---|
| Branch-chain alkylbenzene sulfonate (alkyl = $C_{12}$ avg.) | 20.0 |
| Nonionic component consisting of 4:1 (wt.) mixture of Dobanol 91-4 and Tergitol 13-S-9 | 5.0 |
| Sodium tripolyphosphate | 33.0 |

-continued

| Ingredient | Wt. % |
|---|---|
| Sodium toluene sulfonate | 2.0 |
| Carboxymethylcellulose | 0.6 |
| Sodium sulfate | 21.9 |
| Bentonite clay (0.5 micron diam.) | 2.5 |
| Sodium silicate ($SiO_2$:$Na_2O$ = 2.0) | 5.4 |
| Colorants | 0.1 |
| Water | 9.5 |

The foregoing composition is prepared by preslurrying the bentonite clay and the nonionics at 150°F and admixing the pre-slurry with a crutcher mix comprising the remaining components set forth, also at 150°F. The resulting mix is spray-dried in a tower with an inlet air stream of 600°F at about 300°F to provide the detergent granules.

EXAMPLE IV

An unbuilt, heavy-duty liquid detergent is formulated having the following composition:

| Component | Wt. % |
|---|---|
| Nonionic oil solubilization system comprising 80 wt. % n-$C_{10}(EO)_4$ and 20 wt. % Tergitol 15-S-9 | 33.0 |
| Triethanolamine salt of linear alkylbenzene sulfonic acid wherein the alkyl chain averages 12 carbon atoms in length | 16.1 |
| Triethanolamine (free form) | 5.3 |
| Ethanol | 5.5 |
| Potassium chloride | 2.5 |
| Brighteners, perfumes, dye | 1.2 |
| Water | Balance |

The above composition provides excellent removal of a wide variety of oily soils from cotton, polyester and polyester/cotton fabrics.

Substantially equivalent detergency performance is realized when in the above-described composition the nonionic oil solubilization system is replaced by an equivalent amount of the other mixtures set forth herein in Table I, respectively.

As can be seen from the foregoing, detergent compositions in the manner of the present invention comprising from about 5% to about 100% (preferably about 8% to about 45%) by weight of the surfactant/co-surfactant mixtures herein and from about 0% to about 95% (preferably about 55% to about 95%) by weight of a solid or liquid water-dispersible carrier, provide superior oil-dissolving detergent compositions for use in aqueous laundering baths. The mixtures herein can be added to commercial detergent formulations to impart improved oil removal properties thereto. Such compositions most preferably comprise from about 15% to about 40% by weight of the oil-dissolving mixtures herein, from about 1% to about 20% by weight of a detergent compound to optimize sudsing and to provide broad spectrum cleaning with a variety of fabrics and soil types, and, for heavy duty cleaning use, from about 30% to about 70% of detergency builders.

Fabric softener compositions comprising a major proportion of a quartenary ammonium surface active agent and minor amounts (ca. 1%) of alkoxylate mixtures are known in the art. When employed in such compositions, the alkoxylate mixtures act as emulsion stabilizers, rather than oil solubilizing agents. In contrast, the present compositions are characterized as being free from quaternary compounds.

What is claimed is:

1. A spray dried granular detergent composition containing:

(1) About 20% of a sodium alkyl benzene sulfonate wherein said alkyl group contains an average of 12 carbon atoms; (2) About 5% of a mixture of (a) an ethoxylated primary oxo alcohol having an average molecular weight of 160 and a range of chain lengths between 9 and 11 carbon atoms with a major proportion containing 10 carbon atoms, said alcohol being ethoxylated with about four moles of ethylene oxide per mole of alcohol and (b) an ethoxylated secondary alcohol containing from 11 to 13 carbon atoms with an average chain length of 12 carbon atoms, said alcohol being ethoxylated with 9 moles of ethylene oxide per mole of alcohol; (3) About 33% sodium tripolyphosphate; (4) about 2% sodium toluene sulfonate; (5) About 0.6% sodium carboxymethyl cellulose; (6) About 21.9% sodium sulfate; (7) about 2.5% bentonite clay; (8) About 5.4% of sodium silicate having an $SiO_2$:$Na_2O$ ratio of 2, and (9) the balance water.

* * * * *